US006562559B2

(12) United States Patent
Mydlarz et al.

(10) Patent No.: US 6,562,559 B2
(45) Date of Patent: May 13, 2003

(54) HIGH CHLORIDE EMULSION DOPED WITH COMBINATION OF METAL COMPLEXES

(75) Inventors: Jerzy Z. Mydlarz, Fairport, NY (US); Eric L. Bell, Webster, NY (US); Pamela M. Ferguson, Farmington, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/919,088

(22) Filed: Jul. 31, 2001

(65) Prior Publication Data

US 2003/0073049 A1 Apr. 17, 2003

(51) Int. Cl.[7] ..... G03C 1/09; G03C 1/035

(52) U.S. Cl. ..... 430/567; 430/569; 430/603; 430/604; 430/605

(58) Field of Search ..... 430/567, 569, 430/603, 604, 605

(56) References Cited

U.S. PATENT DOCUMENTS

| | | | |
|---|---|---|---|
| 4,933,272 | A | 6/1990 | McDugle et al. |
| 4,945,035 | A | 7/1990 | Keevert, Jr. et al. |
| 5,360,712 | A | 11/1994 | Olm et al. |
| 5,457,021 | A | 10/1995 | Olm et al. |
| 5,462,849 | A | 10/1995 | Kuromoto et al. |
| 5,470,771 | A | 11/1995 | Fujii et al. |
| 5,474,888 | A | 12/1995 | Bell |
| 5,494,789 | A | 2/1996 | Daubendiek et al. |
| 5,500,335 | A | 3/1996 | Bell |
| 5,503,970 | A | 4/1996 | Olm et al. |
| 5,503,971 | A | 4/1996 | Daubendiek et al. |
| 5,597,686 | A | 1/1997 | MacIntyre et al. |
| 5,783,373 | A | 7/1998 | Mydlarz et al. |
| 5,783,378 | A | 7/1998 | Mydlarz et al. |
| 5,830,631 | A | 11/1998 | Hendricks et al. |
| 6,017,684 | A | 1/2000 | Miyake |
| 6,107,018 | A | 8/2000 | Mydlarz et al. |
| 6,159,679 | A | 12/2000 | Vandenbroucke |
| 6,162,599 | A | 12/2000 | Vandenbroucke et al. |
| 6,242,172 | B1 | 6/2001 | Budz et al. |

FOREIGN PATENT DOCUMENTS

| | | |
|---|---|---|
| EP | 862 084 | 9/1998 |
| EP | 800 109 | 10/1998 |
| EP | 928 988 A1 | 7/1999 |
| EP | 1 033 616 | 9/2000 |
| JP | 7-72576 | 3/1995 |

OTHER PUBLICATIONS

Abstract for JP 5142712, published Jun. 11, 1993, titled "Image Forming Method", of Fuji Photo Film.

*Primary Examiner*—Janet Baxter
*Assistant Examiner*—Amanda C. Walke
(74) *Attorney, Agent, or Firm*—Andrew J. Anderson

(57) ABSTRACT

A radiation-sensitive emulsion comprised of silver halide grains (a) containing greater than 50 mole percent chloride, based on silver, (b) having greater than 50 percent of their surface area provided by {100} crystal faces, and (c) having a central portion accounting for up to 99 percent of total silver and containing (i) a first dopant comprising an iridium coordination complex containing at least one thiazole ligand and (ii) a second dopant comprising an iridium coordination complex containing at least one substituted thiazole ligand. The combined use of first and second iridium dopants in accordance with the invention provides enhanced toe contrast softening, and can also result in improved latent image keeping stability relative to that expected from the individual effects of such dopants.

20 Claims, No Drawings

HIGH CHLORIDE EMULSION DOPED WITH COMBINATION OF METAL COMPLEXES

FIELD OF THE INVENTION

This invention is directed to radiation sensitive silver halide emulsions useful in photography, including electronic printing methods wherein information is recorded in a pixel-by-pixel mode in a radiation silver halide emulsion layer, comprising a combination of specified dopants.

DEFINITION OF TERMS

The term "high chloride" in referring to silver halide grains and emulsions indicates that chloride is present in a concentration of greater than 50 mole percent, based on total silver.

In referring to grains and emulsions containing two or more halides, the halides are named in order of ascending concentrations.

All references to the periodic table of elements periods and groups in discussing elements are based on the Periodic Table of Elements as adopted by the American Chemical Society and published in the *Chemical and Engineering News*, Feb. 4, 1985, p. 26. The term "Group VIII" is used to generically describe elements in groups 8, 9 and 10.

The term "cubic grain" is employed to indicate a grain is that bounded by six {100} crystal faces. Typically the comers and edges of the grains show some rounding due to ripening, but no identifiable crystal faces other than the six {100} crystal faces. The six {100} crystal faces form three pairs of parallel {100} crystal faces that are equidistantly spaced.

The term "cubical grain" is employed to indicate grains that are at least in part bounded by {100} crystal faces satisfying the relative orientation and spacing of cubic grains. That is, three pairs of parallel {100} crystal faces are equidistantly spaced. Cubical grains include both cubic grains and grains that have one or more additional identifiable crystal faces. For example, tetradecahedral grains having six {100} and eight {111} crystal faces are a common form of cubical grains.

The term "tabular grain" indicates a grain having two parallel major crystal faces (face which are clearly larger than any remaining crystal face) and having an aspect ratio of at least 2.

The term "aspect ratio" designates the ratio of the equivalent circular diameter of a major face to grain thickness.

The term "tabular grain emulsion" refers to an emulsion in which tabular grains account for greater than 50 percent of total grain projected area.

The term "{100} tabular" is employed in referring to tabular grains and tabular grain emulsions in which the tabular grains have {100} major faces.

The term "equivalent spherical diameter" in referring to silver halide grains refers to the diameter of a sphere which has the same volume of an individual grain.

The term "central portion" in referring to silver halide grains refers to that portion of the grain structure that is first precipitated accounting for up to 99 percent of total precipitated silver required to form the grains.

The term "dopant" is employed to indicate any material within the rock salt face centered cubic crystal lattice structure of a silver halide grain other than silver ion or halide ion.

The term "dopant band" is employed to indicate the portion of the grain formed during the time that dopant was introduced to the grain during precipitation process.

The term "surface modifier" refers to any material other than silver ion or halide ion that is associated with a portion of the silver halide grains other than the central portion.

The term "log E" is the logarithm of exposure in lux-seconds.

Speed is reported as relative log speed, where 1.0 relative log speed units is equal to 0.01 log E.

The term "contrast" or "$\gamma$" is employed to indicate the slope of a line drawn from stated density points on the characteristic curve.

The term "reciprocity law failure" refers to the variation in response of an emulsion to a fixed light exposure due to variation in the specific exposure time.

*Research Disclosure* is published by Kenneth Mason Publications, Ltd., Dudley House, 12 North St., Emsworth, Hampshire P010 7DQ, England.

BACKGROUND

In its most commonly practiced form silver halide photography employs a film in a camera to produce, following photographic processing, a negative image on a transparent film support. A positive image for viewing is produced by exposing a photographic print element containing one or more silver halide emulsion layers coated on a reflective white support through the negative image in the camera film, followed by photographic processing. Whereas high bromide silver halide emulsions are the overwhelming commercial choice for camera films, high chloride grain emulsions are the overwhelming commercial choice for photographic print elements. In a relatively recent variation negative image information is retrieved by scanning and stored in digital form. The digital image information is later used to expose imagewise the emulsion layer or layers of the photographic print element. Whether a conventional optical or a digital image printing exposure is employed, it is desired in high chloride emulsions for color paper applications to obtain high photographic speed at the desired sensitometric curve shape.

A typical example of imaging systems which require that a hard copy be provided from an image which is in digital form is electronic printing of photographic images which involves control of individual pixel exposure. Such a system provides greater flexibility and the opportunity for improved print quality in comparison to optical methods of photographic printing. In a typical electronic printing method, an original image is first scanned to create a digital representation of the original scene. The data obtained is usually electronically enhanced to achieve desired effects such as increased image sharpness, reduced graininess and color correction. The exposure data is then provided to an electronic printer which reconstructs the data into a photographic print by means of small discrete elements (pixels) that together constitute an image. In a conventional electronic printing method, the recording element is scanned by one or more high energy beams to provide a short duration exposure in a pixel-by-pixel mode using a suitable source, such as a light emitting diode (LED) or laser. A cathode ray tube (CRT) is also sometimes used as a printer light source in some devices. Such methods are described in the patent literature, including, for example, Hioki U.S. Pat. No. 5,126,235; European Patent Application 479 167 A1 and European Patent Application 502 508 A1. Also, many of the basic principles of electronic printing are provided in Hunt, The

*Reproduction of Colour*, Fourth Edition, pages 306–307, (1987). Budz et al U.S. Pat. No. 5,451,490 discloses an improved electronic printing method which comprises subjecting a radiation sensitive silver halide emulsion layer of a recording element to actinic radiation of at least $10^{-4}$ ergs/cm$^2$ for up to 100 $\mu$ seconds duration in a pixel-by-pixel mode. The radiation sensitive silver halide emulsion layer contains a silver halide grain population comprising at least 50 mole percent chloride, based on silver, forming the grain population projected area. At least 50 percent of the grain population projected area is accounted for by tabular grains that are bounded by {100} major faces having adjacent edge ratios of less than 10, each having an aspect ratio of at least 2. The substitution of a high chloride tabular grain emulsion for a high chloride cubic grain emulsion was demonstrated to reduce high intensity reciprocity failure (HIRF).

Electronic digital printing onto silver halide media frequently is subject to the appearance of various digital printing artifacts. Image artifacts which may be associated with optical scan printing on silver halide media include "digital fringing", "contouring", and "banding". Of the artifacts associated with printing digital images onto silver halide media, "digital fringing", or the formation of visually soft edges, especially around text, probably elicits the greatest objections. This artifact pertains to unwanted density formed in an area of a digital print as a result of a scanning exposure in a different area of the print. Digital fringing may be detected in pixels many lines away from area(s) of higher exposure, creating an underlying minimum density or Dmin that reduces sharpness and degrades color reproduction. "Contouring" refers to the formation of discrete density steps in highlight regions where the gradations should appear continuous. Bit limited system modulators (those that use >=210 bits, or 1024 DAC levels, designated 10 bit), e.g., may have too few levels to calibrate for density differences that are below the detection threshold of the human eye. A single bit change in exposure may, therefore, produce a density change large enough to see as a step, or contour. "Banding" is the appearance of lines, or bands, having a lower frequency than the individual raster lines, but which are parallel to the line scan direction. The bands arise from non-uniformity in the overlap exposure between scans (e.g., from mechanical vibrations) causing fluctuations in exposure in the overlap areas large enough to produce a visually detectable difference in density.

One of the most important parameters describing suitability of color paper for digital exposure is "dynamic range", which may be defined as the amount of energy that has to be delivered to an emulsion to reach the desired printing density. For most digital printing devices the dynamic range should be equal to about 1 logE. Too wide dynamic range may result in the appearance of digital fringing in a color paper. The minimum exposure at which digital fringing becomes visually objectionable varies by digital printing device and emulsion photographic properties. Because fringing increases with exposure, the useful density range for typical commercial color photographic papers printed by scanning laser or LED (light emitting diode) exposures must be restricted to 2.2 or below, less than the full density range of the papers. Fine line images require even lower print densities due to the acute sensitivity of the eye to softening of high contrast edges.

Proper design of the paper's D-log E "characteristic curve" (see, e.g., James, The Theory of the Photographic Process", 4$^{th}$ Ed. Pp. 501–504) can help minimize the occurrence of digital artifacts. In order to reduce digital fringing, e.g., a relatively high contrast is desired to enable a desired dynamic range. A relatively soft toe is also desired in the characteristic curve, however, to reduce the occurrence of banding and contouring. Lower contrast toe regions of the paper characteristic curves can alleviate contouring in a 10 bit system, e.g., as taught by Kawai, Kokai JP 05/142712-A, but the low contrast also lowers the density threshold for digital fringing.

The use of dopants in silver halide grains to modify photographic performance is well know in the photographic art, as generally illustrated, e.g., by *Research Disclosure*, Item 38957, I. Emulsion grains and their preparation, D. Grain modifying conditions and adjustments, paragraphs (3)–(5). Photographic performance attributes known to be affected by dopants include sensitivity, reciprocity failure, and contrast. The features of high contrast in the shoulder area and relatively soft toe contrast desired for digital printing can be obtained for color paper photographic emulsions through selection of appropriate contrast and speed enhancing dopants.

Using empirical techniques the art has over the years identified many dopants capable of increasing photographic speed. Keevert et al U.S. Pat. No. 4,945,035, e.g., was the first to teach the incorporation of a hexacoordination complex containing a transition metal and cyano ligands as a dopant in high chloride grains to provide increased sensitivity. Scientific investigations have gradually established that one general class of such speed increasing dopants share the capability of providing shallow electron trapping sites. Olm et al U.S. Pat. No. 5,503,970 and Daubendiek et al U.S. Pat. Nos. 5,494,789 and 5,503,971, here incorporated by reference, as well as *Research Disclosure*, Vol. 367, Nov. 1994, Item 36736, were the first to set out comprehensive criteria for a dopant to have the capability of providing shallow electron trapping sites.

The contrast of photographic elements containing silver halide emulsions can generally be increased by incorporating into the silver halide grains a dopant capable of creating deep electron trapping sites, such as illustrated by R. S. Eachus, R. E. Graves and M. T. Olm *J. Chem. Phys.*, Vol. 69, pp. 4580–7 (1978) and *Physica Status Solidi A*, Vol. 57, 429–37 (1980) and R. S. Eachus and M. T. Olm Annu. *Rep. Prog. Chem. Sect. C. Phys. Chem.*, Vol. 83, 3, pp. 348 (1986). U.S. Pat. Nos. 5,783,373 and 5,783,378 discuss use of combinations of transition metal complex dopants containing a nitrosyl or thionitrosyl ligand with shallow electron trapping dopants (and further with iridium coordination complex dopants for reciprocity performance) for high chloride emulsions in order to provide increased contrast in a photographic print material specifically for use in digital imaging. The use of dopant coordination complexes containing organic ligands is disclosed by Olm et al U.S. Pat. No. 5,360,712, Olm et al U.S. Pat. No. 5,457,021 and Kuromoto et al U.S. Pat. No. 5,462,849.

It has become increasing clear that with the continuing development of a variety of high intensity digital printing devices that photographic print materials with performance invariant to exposure time is increasingly important. When exposure times are reduced below one second to very short intervals (e.g., $10^{-5}$ second or less), higher exposure intensities must be employed to compensate for the reduced exposure times. High intensity reciprocity failure (hereinafter also referred to as HIRF) occurs when photographic performance is noted to depart from the reciprocity law when such shorter exposure times are employed. Print materials which traditionally suffer speed or contrast losses at short exposure times (high intensity exposures) will fail to reproduce detail with high resolution. Text will appear blurred. Through-put of digital print devices will suffer as well. Accordingly, print materials with reduced HIRF are desired in order to produce excellent photographic prints in a wide variety of digital printers. In addition to reducing HIRF, it is also desirable to reduce low intensity reciprocity failure (LIRF) in photographic elements. Print materials with reduced LIRF, e.g., will allow enlargements of photographs to be made by conventional optical printing techniques with a more faithful matching of image tone and color.

Doping with iridium is commonly performed to reduce reciprocity law failure in silver halide emulsions. According to the photographic law of reciprocity, a photographic element should produce the same image with the same exposure, even though exposure intensity and time are varied. For example, an exposure for 1 second at a selected intensity should produce exactly the same result as an exposure of 2 seconds at half the selected intensity. When photographic performance is noted to diverge from the reciprocity law, this is known as reciprocity failure. In addition to reciprocity improvements, some iridium dopants also can impact other sensitometric properties. Specific iridium dopants proposed for use in high chloride emulsions include hexachloride complexes such as those illustrated by Bell U.S. Pat. Nos. 5,474,888, 5,470,771 and 5,500,335 and McIntyre et al U.S. Pat. No. 5,597,686. Specific combinations of iridium and other metal dopants may additionally be found in U.S. Pat. Nos. 4,828,962, 5,153,110, 5,219,722, 5,227,286, and 5,229,263, and European Patent Applications EP 0 244 184, EP 0 405 938, EP 0 476 602, EP 0 488 601, EP 0 488 737, EP 0 513 748, and EP 0514 675.

The use of iridium dopants for improved reciprocity performance, however, has generally required the use of relatively high levels of iridium doping which may lead to latent image keeping problems. The use of iridium coordination complexes containing at least one thiazole or substituted thiazole ligand have been found to be preferred iridium dopants for providing improved reciprocity performance while minimizing undesirable latent image keeping problems and undesired sensitometric changes. U.S. Pat. No. No. 6,107,018, e.g., discloses that a combination of such iridium dopants and shallow electron trapping dopants in high chloride emulsion grains provides greater reduction in reciprocity law failure than can be achieved with either dopant alone, particularly for high intensity and short duration exposures, enabling high intensity reciprocity with iridium at relatively low levels. It would be desirable to further improve upon the performance of photographic emulsions employing iridium dopants for reciprocity performance, while also enabling improved sensitometric properties, especially for enabling lower toe contrast in emulsions for use in high intensity digital printing processes.

SUMMARY OF THE INVENTION

In one aspect this invention is directed towards a radiation-sensitive emulsion comprised of silver halide grains (a) containing greater than 50 mole percent chloride, based on silver, (b) having greater than 50 percent of their surface area provided by {100} crystal faces, and (c) having a central portion accounting for up to 99 percent of total silver and containing (i) a first dopant comprising an iridium coordination complex containing at least one thiazole ligand and (ii) a second dopant comprising an iridium coordination complex containing at least one substituted thiazole ligand.

In a second aspect, this invention is directed towards a photographic recording element comprising a support and at least one light sensitive silver halide emulsion layer comprising silver halide grains as described above.

In another aspect, this invention is directed to an electronic printing method which comprises subjecting a radiation sensitive silver halide emulsion layer of a recording element to actinic radiation of at least $10^{-4}$ ergs/cm$^2$ for up to 100$\mu$ seconds duration in a pixel-by-pixel mode, wherein the silver halide emulsion layer is comprised of silver halide grains as described above.

While iridium coordination complexes containing at least one thiazole ligand and iridium coordination complexes containing at least one substituted thiazole ligand have been previously disclosed as alternatives, it has been discovered that the combined use of first and second iridium dopants in accordance with the invention quite surprisingly provides enhanced toe contrast softening, and can also result in improved latent image keeping stability relative to that expected from the individual effects of such dopants. In a preferred practical application, the advantages of the invention can be transformed into increased throughput of digital artifact-free color print images while exposing each pixel sequentially in synchronism with the digital data from an image processor.

DESCRIPTION OF THE EMBODIMENTS

In one embodiment, the present invention represents an improvement on the electronic printing method disclosed by Budz et al, cited above and here incorporated by reference. Specifically, this invention in one embodiment is directed to an electronic printing method which comprises subjecting a radiation sensitive silver halide emulsion layer of a recording element to actinic radiation of at least $10^{-4}$ ergs/cm$^2$ for up to 100$\mu$ seconds duration in a pixel-by-pixel mode. The present invention realizes an improvement in latent image keeping by modifying the radiation sensitive silver halide emulsion layer. While certain embodiments of the invention are specifically directed towards electronic printing, use of the emulsions and elements of the invention is not limited to such specific embodiment, and it is specifically contemplated that the emulsions and elements of the invention are also well suited for conventional optical printing.

Emulsions in accordance with the invention comprise high chloride silver halide grains, which include a doped inner portion including (i) a first dopant comprising an iridium coordination complex containing at least one thiazole ligand and (ii) a second dopant comprising an iridium coordination complex containing at least one substituted thiazole ligand. Preferably, each of the first and second dopants are iridium coordination complexes having ligands each of which are more electropositive than a cyano ligand. In a specifically preferred form the remaining non-thiazole or non-substituted-thiazole ligands of the first and second iridium dopant coordination complexes are halide ligands. The iridium dopants employed in the practice of this invention are believed to create deep electron traps.

For the second dopant, the substituted thiazole ligand may be a thiazole group substituted with any photographically acceptable substituent which does not prevent incorporation of the dopant into the silver halide grain. Exemplary substituents include lower alkyl (e.g., alkyl groups containing 1–4 carbon atoms), and specifically methyl. A specific example of a substituted thiazole ligand which may be used for the second dopant in accordance with the invention is 5-methylthiazole.

In a preferred form it is contemplated to employ as the first and second iridium dopants hexacoordination complexes satisfying the formula:

$$[IrL^1_6]^{n'} \quad (I)$$

wherein n' is zero, −1, −2, −3 or 4; and $L^1_6$ represents six bridging ligands which can be independently selected, provided that at least four of the ligands are anionic ligands, each of the ligands is more electropositive than a cyano ligand, and at least one of the ligands comprises a thiazole or substituted thiazole ligand. In a specifically preferred form at least four of the ligands are halide ligands, such as chloride or bromide ligands.

Specific illustrations of (i) first dopant comprising an iridium coordination complexes containing at least one thiazole ligand include the following:

(i-1) $[IrCl_5(thiazole)]^{-2}$ (i-2) $[IrCl_4(thiazole)_2]^{-1}$ (i-3) $[IrBr_5(thiazole)]^{-2}$ (i-4) $[IrBr_4(thiazole)_2]^{-1}$ Specific illustrations of (ii) second dopant comprising an iridium coordination complexes containing at least one substituted thiazole ligand include the following:

(ii- 1) $[IrCl_5(5\text{-methylthiazole})]^{-2}$ (ii-2) $[IrCl_4(5\text{-methylthiazole})_2]^{-1}$ (ii-3) $[IrBr_5(5\text{-methylthiazole})]^{-2}$ (ii-4) $[IrBr_4(5\text{-methylthiazole})_2]^{-1}$ When the iridium dopants have a net negative charge, it is appreciated that they are associated with a counter ion when added to the reaction vessel during precipitation. The counter ion is of little importance, since it is ionically dissociated from the dopant in solution and is not incorporated within the grain. Common counter ions known to be fully compatible with silver chloride precipitation, such as anmmonium and alkali metal ions, are contemplated.

Emulsions demonstrating the advantages of the invention can be realized by modifying the precipitation of conventional high chloride silver halide grains having predominantly (>50%) {100} crystal faces by employing a combination of (i) first and (ii) second iridium coordination complex dopants as described above. The (i) first and (ii) second iridium coordination complex dopants are preferably introduced into the high chloride grains after at least 50 (most preferably 85 and optimally 90) percent of the silver has been precipitated, but before precipitation of the central portion of the grains has been completed. Preferably the (i) first and (ii) second iridium coordination complex dopants class (ii) dopants are introduced before 99 (most preferably 97 and optimally 95) percent of the silver has been precipitated. Stated in terms of the fully precipitated grain structure, the (i) first and (ii) second iridium coordination complex dopants are preferably present in an interior shell region that surrounds at least 50 (most preferably 85 and optimally 90) percent of the silver and, with the more centrally located silver, accounts the entire central portion (99 percent of the silver), most preferably accounts for 97 percent, and optimally accounts for 95 percent of the silver halide forming the high chloride grains. Each of the (i) first and (ii) second iridium coordination complex dopants can be distributed throughout the interior shell region delimited above or can be added as one or more bands within the interior shell region. To be located within a common dopant band, both dopants may be introduced concurrently (either by separate jets or by a common jet) into a silver halide reaction vessel during precipitation of at least a part of the central portion of the emulsion grains. The (i) first and (ii) second iridium coordination complex dopants can be employed in any conventional useful concentrations. A preferred concentration range for each dopant is from $10^{-9}$ to $10^{-4}$ mole per silver mole. The (i) first dopant comprising an iridium coordination complex containing at least one thiazole ligand is most preferably employed in a concentration range of from $10^{-8}$ to $10^{-5}$ mole per silver mole, while the (ii) second dopant comprising an iridium coordination complex containing at least one substituted thiazole ligand is most preferably employed in a concentration range of from $10^{-8}$ to $10^{-5}$ mole per silver mole.

The performance improvements described in accordance with the invention may be obtained for silver halide grains employing conventional gelatino-peptizer, as well as oxidized gelatin (e.g., gelatin having less than 30 micromoles of methionine per gram). Accordingly, in specific embodiments of the invention, it is specifically contemplated to use significant levels (i.e., greater than 1 weight percent of total peptizer) of conventional gelatin (e.g., gelatin having at least 30 micromoles of methionine per gram) as a gelatino-peptizer for the silver halide grains of the emulsions of the invention. In preferred embodiments of the invention, gelatino-peptizer is employed which comprises at least 50 weight percent of gelatin containing at least 30 micromoles of methionine per gram, as it is frequently desirable to limit the level of oxidized low methionine gelatin which may be used for cost and certain performance reasons.

The silver halide grains precipitated contain greater than 50 mole percent chloride, based on silver. Preferably the grains contain at least 70 mole percent chloride and, optimally at least 90 mole percent chloride, based on silver. Iodide can be present in the grains up to its solubility limit, which is in silver iodochloride grains, under typical conditions of precipitation, about 11 mole percent, based on silver. It is preferred for most photographic applications to limit iodide to less than 5 mole percent iodide, most preferably less than 2 mole percent iodide, based on silver.

Silver bromide and silver chloride are miscible in all proportions. Hence, any portion, up to 50 mole percent, of the total halide not accounted for chloride and iodide, can be bromide. For color reflection print (i.e., color paper) uses bromide is typically limited to less than 10 mole percent based on silver and iodide is limited to less than 1 mole percent based on silver.

The silver halide grains of photographic emulsions in accordance with the invention may also include other dopants, such as nitrosyl or thionitrosyl ligand containing dopants as disclosed in U.S. Pat. Nos. 4,933,272, 5,783,373 and 5,783,378, as well as shallow electron trapping dopants as disclosed in U.S. Pat. No. 6,107,018, the disclosures of which are here incorporated by reference.

In a widely used form high chloride grains are precipitated to form cubic grains, that is, grains having {100} major faces and edges of equal length. In practice ripening effects usually round the edges and corners of the grains to some extent. However, except under extreme ripening conditions substantially more than 50 percent of total grain surface area is accounted for by {100} crystal faces.

High chloride tetradecahedral grains are a common variant of cubic grains. These grains contain 6 {100} crystal faces and 8 {111} crystal faces. Tetradecahedral grains are within the contemplation of this invention to the extent that greater than 50 percent of total surface area is accounted for by {100} crystal faces.

Although it is common practice to avoid or minimize the incorporation of iodide into high chloride grains employed in color paper, it is has been recently observed that silver iodochloride grains with {100} crystal faces and, in some instances, one or more {111} faces offer exceptional levels of photographic speed. In the these emulsions iodide is incorporated in overall concentrations of from 0.05 to 3.0 mole percent, based on silver, with the grains having a surface shell of greater than 50 Å that is substantially free of iodide and a interior shell having a maximum iodide concentration that surrounds a core accounting for at least 50 percent of total silver. Such grain structures are illustrated by Chen et al EPO 0 718 679.

In another improved form the high chloride grains can take the form of tabular grains having {100} major faces. Preferred high chloride {100} tabular grain emulsions are those in which the tabular grains account for at least 70 (most preferably at least 90) percent of total grain projected area. Preferred high chloride {100} tabular grain emulsions have average aspect ratios of at least 5 (most preferably at least >8). Tabular grains typically have thicknesses of less than 0.3 μm, preferably less than 0.2 μm, and optimally less than 0.07 μm. High chloride {100} tabular grain emulsions and their preparation are disclosed by Maskasky U.S. Pat. Nos. 5,264,337 and 5,292,632, House et al U.S. Pat. No. 5,320,938, Brust et al U.S. Pat. No. 5,314,798 and Chang et al U.S. Pat. No. 5,413,904, the disclosures of which are here incorporated by reference.

Once high chloride grains having predominantly {100} crystal faces have been precipitated doped with a combination of dopants as described above, chemical and spectral sensitization, followed by the addition of conventional addenda to adapt the emulsion for the imaging application of choice can take any convenient conventional form. The conventional features are further illustrated by *Research Disclosure*, Item 38957, cited above, particularly:

| | |
|---|---|
| III. | Emulsion washing; |
| IV. | Chemical sensitization; |
| V. | Spectral sensitization and desensitization; |
| VII. | Antifoggants and stabilizers; |
| VIII. | Absorbing and scattering materials; |
| IX. | Coating and physical property modifying addenda; and |
| X. | Dye image formers and modifiers. |

As pointed out by Bell, cited above, some additional silver halide, typically less than 1 percent, based on total silver, can be introduced to facilitate chemical sensitization. It is also recognized that silver halide can be epitaxially deposited at selected sites on a host grain to increase its sensitivity. For example, high chloride {100} tabular grains with comer epitaxy are illustrated by Maskasky U.S. Pat. No. 5,275,930. For the purpose of providing a clear demarcation, the term "silver halide grain" is herein employed to include the silver necessary to form the grain up to the point that the final {100} crystal faces of the grain are formed. Silver halide later deposited that does not overlie the {100} crystal faces previously formed accounting for at least 50 percent of the grain surface area is excluded in determining total silver forming the silver halide grains. Thus, the silver forming selected site epitaxy is not part of the silver halide grains while silver halide that deposits and provides the final {(100} crystal faces of the grains is included in the total silver forming the grains, even when it differs significantly in composition from the previously precipitated silver halide.

In the simplest contemplated form a photographic element of the invention can consist of a single emulsion layer satisfying the emulsion description provided above coated on a conventional photographic support, such as those described in *Research Disclosure*, Item 38957, cited above, XVI. Supports. In one preferred form the support is a white reflective support, such as photographic paper support or a film support that contains or bears a coating of a reflective pigment. To permit a print image to be viewed using an illuminant placed behind the support, it is preferred to employ a white translucent support, such as a Duratrans™ or Duraclear™ support.

The photographic elements and printing methods of the invention can be used to form either silver or dye images in the recording element. In a simple form a single radiation sensitive emulsion layer unit is coated on the support. The elements can contain one or more high chloride silver halide emulsions satisfying the requirements of the invention. When a dye imaging forming compound, such as a dye-forming coupler, is present it can be in an emulsion layer or in a layer coated in contact with the emulsion layer. With a single emulsion layer unit a monochromatic image is obtained.

In a preferred embodiment the invention employs recording elements which are constructed to contain at least three silver halide emulsion layer units. A suitable multicolor, multilayer format for a recording element used in the invention is represented by Structure I.

| STRUCTURE I |
|---|
| Blue-sensitized |
| yellow dye image-forming silver halide emulsion unit |
| Interlayer |
| Green-sensitized |
| magenta dye image-forming silver halide emulsion unit |
| Interlayer |
| Red-sensitized |
| cyan dye image-forming silver halide emulsion unit |
| ///// Support ///// |

wherein the red-sensitized, cyan dye image-forming silver halide emulsion unit is situated nearest the support; next in order is the green-sensitized, magenta dye image-forming unit, followed by the uppermost blue-sensitized, yellow dye image-forming unit. The image-forming units are separated from each other by hydrophilic colloid interlayers containing an oxidized developing agent scavenger to prevent color contamination. Silver halide emulsions satisfying the requirements described above can be present in any one or combination of the emulsion layer units. Additional useful multicolor, multilayer formats for an element of the invention include Structures II–IV as described in U.S. Pat. No. 5,783,373 referenced above, which is incorporated by reference herein. Each of such structures in accordance with the invention would contain at least one silver halide emulsion comprised of high chloride grains having at least 50 percent of their surface area bounded by {100} crystal faces and containing dopants as described above. Preferably each of the emulsion layer units contain an emulsion satisfying these criteria.

Conventional features that can be incorporated into multilayer (and particularly multicolor) recording elements contemplated for use in the invention are illustrated by *Research Disclosure*, Item 38957, cited above:

| | |
|---|---|
| XI. | Layers and layer arrangements |
| XII. | Features applicable only to color negative |
| XIII. | Features applicable only to color positive |
| | B. Color reversal |
| | C. Color positives derived from color negatives |
| XIV. | Scan facilitating features. |

The recording elements comprising the radiation sensitive high chloride emulsion layers according to this invention can be conventionally optically printed, or in accordance with a particular embodiment of the invention can be image-wise exposed in a pixel-by-pixel mode using suitable high energy radiation sources typically employed in electronic printing methods. Suitable actinic forms of energy encompass the ultraviolet, visible and infrared regions of the electromagnetic spectrum as well as electron-beam radiation and is conveniently supplied by beams from one or more light emitting diodes or lasers, including gaseous or solid state lasers. Exposures can be monochromatic, orthochromatic or panchromatic. For example, when the recording element is a multilayer multicolor element, exposure can be provided by laser or light emitting diode beams of appropriate spectral radiation, for example, infrared, red, green or blue wavelengths, to which such element is sensitive. Multicolor elements can be employed which produce cyan, magenta and yellow dyes as a function of exposure in separate portions of the electromagnetic spectrum, including at least two portions of the infrared region, as disclosed in the previously mentioned U.S. Pat. No. 4,619,892, incorporated herein by reference. Suitable exposures include those up to 2000 nm, preferably up to 1500 nm. The exposing source need, of course, provide radiation in only one spectral region if the recording element is a monochrome element sensitive to only that region (color) of the electromagnetic spectrum. Suitable light emitting diodes and commercially available laser sources are described in the examples. Imagewise exposures at ambient, elevated or reduced temperatures and/or pressures can be employed within the useful response range of the recording element determined by conventional sensitometric techniques, as illustrated by T. H. James, *The Theory of the Photographic Process*, 4th Ed., Macmillan, 1977, Chapters 4, 6, 17, 18 and 23.

The quantity or level of high energy actinic radiation provided to the recording medium by the exposure source is generally at least $10^{-4}$ ergs/cm$^2$, typically in the range of about $10^{-4}$ ergs/cm$^2$ to $10^{-3}$ ergs/cm$^2$ and often from $10^{-3}$ ergs/cm$^2$ to $10^2$ ergs/cm$^2$. Exposure of the recording element in a pixel-by-pixel mode as known in the prior art persists for only a very short duration or time. Typical maximum exposure times are up to 100$\mu$ seconds, often up to $10^{-4}$ seconds, and frequently up to only 0.5$\mu$ seconds. Single or multiple exposures of each pixel are contemplated. The pixel density is subject to wide variation, as is obvious to those skilled in the art. The higher the pixel density, the sharper the images can be, but at the expense of equipment complexity. In general, pixel densities used in conventional electronic printing methods of the type described herein do not exceed $10^7$ pixels/cm$^2$ and are typically in the range of about $10^4$ to $10^6$ pixels/cm$^2$. An assessment of the technology of high-quality, continuous-tone, color electronic printing using silver halide photographic paper which discusses various features and components of the system, including exposure source, exposure time, exposure level and pixel density and other recording element characteristics is provided in Firth et al., *A Continuous-Tone Laser Color Printer*, Journal of Imaging Technology, Vol. 14, No. 3, June 1988, which is hereby incorporated herein by reference. As previously indicated herein, a description of some of the details of conventional electronic printing methods comprising scanning a recording element with high energy beams such as light emitting diodes or laser beams, are set forth in Hioki U.S. Pat. No. 5,126,235, European Patent Applications 479 167 A1 and 502 508 A1, the disclosures of which are hereby incorporated herein by reference.

Once imagewise exposed, the recording elements can be processed in any convenient conventional manner to obtain a viewable image. As demonstrated in the examples below, photographic elements in accordance with the invention demonstrate improved latent image keeping performance, decreasing the impact of delays in processing which may occur after imagewise exposure. Conventional processing is illustrated, e.g., by *Research Disclosure*, Item 38957, cited above:

| | |
|---|---|
| XVIII. | Chemical development systems |
| XIX. | Development |
| XX. | Desilvering, washing, rinsing and stabilizing |

EXAMPLES

This invention can be better appreciated by reference to the following Examples. Emulsions EM-1 throughout EM-26 illustrate the preparation of radiation sensitive high chloride emulsions, both for comparison and inventive emulsions. Examples 1 through 4 illustrate that recording elements containing layers of such emulsions exhibit characteristics that make them particularly useful in very fast optical printers and in electronic printing methods of the type described herein.

Example 1

This example compares the effects of $K_2IrCl_5$(Thiazole), $K_2IrCl_5$(5-Methyl-Thiazole) and the dopant combination on the optical contrast of emulsions sensitized to red light.

Emulsion EM-1: A reaction vessel contained 6.92 L of a solution that was 3.8% in regular gelatin and contained 1.71 g of a Pluronic antifoam agent. To this stirred solution at 46° C. 83.5 mL of 3.0 M NaCl was dumped, and soon after 28.3 mL of dithiaoctanediol solution was poured into the reactor. A half minute after addition of dithiaoctanediol solution, 104.5 mL of a 2.8 M $AgNO^3$ solution and 107.5 mL of 3.0 M NaCl were added simultaneously at 209 mL/min for 0.5 minute. The vAg set point was chosen equal to that observed in the reactor at this time. Then the 2.8 M silver nitrate solution and the 3.0 M sodium chloride solution were added simultaneously with a constant flow at 209 mL/min over 20.75 minutes. During precipitation, 16.54 milligrams per silver mole of $K_4Ru(CN)_6$ was added during 75 to 80% of grain formation. The resulting silver chloride emulsion had a cubic shape that was 0.38 $\mu$m in edgelength. The emulsion was then washed using an ultrafiltration unit, and its final pH and pCl were adjusted to 5.6 and 1.8, respectively.

Emulsion EM-2: This emulsion was precipitated exactly as Emulsion EM-1, except that 0.04 milligrams per silver mole of $K_2IrCl$, (Thiazole) was added during 90 to 95% of grain formation.

Emulsion EM-3: This emulsion was precipitated exactly as Emulsion EM-1, except that 0.08 milligrams per silver mole of $K_2IrCl$, (Thiazole) was added during 90 to 95% of grain formation.

Emulsion EM4: This emulsion was precipitated exactly as Emulsion EM-1, except that 0.16 milligrams per silver mole of $K_2IrCl_5$ (Thiazole) was added during 90 to 95% of grain formation.

Emulsion EM-5: This emulsion was precipitated exactly as Emulsion EM-1, except that 0.24 milligrams per silver mole of $K_2IrCl_5$ (Thiazole) was added during 90 to 95% of grain formation.

Emulsion EM-6: This emulsion was precipitated exactly as Emulsion EM-1, except that 0.08 milligrams per silver mole of $K_2IrCl_5$ (5-Methyl-Thiazole) was added during 90 to 95% of grain formation.

Emulsion EM-7: This emulsion was precipitated exactly as Emulsion EM-1, except that 0.08 milligrams per silver mole of $K_2IrCl_5$ (5-Methyl-Thiazole) and 0,04 milligrams per silver mole of $K_2IrCl_5$ (Thiazole) were added during 90 to 95% of grain formation. Each dopant was added to the reaction vessel through a separate jet.

Emulsion EM-8: This emulsion was precipitated exactly as Emulsion EM-1, except that 0.08 milligrams per silver mole of $K_2IrCl_5$ (5-Methyl-Thiazole) and 0.08 milligrams per silver mole of $K_2IrCl_5$ (Thiazole) were added during 90 to 95% of grain formation. Each dopant was added to the reaction vessel through a separate jet.

Emulsion EM-9: This emulsion was precipitated exactly as Emulsion EM-1, except that 0.08 milligrams per silver mole of $K_2IrCl_5$ (5-Methyl-Thiazole) and 0.16 milligrams per silver mole of $K_2IrCl_5$ (Thiazole) were added during 90 to 95% of grain formation. Each dopant was added to the reaction vessel through a separate jet.

Emulsion EM-10: This emulsion was precipitated exactly as Emulsion EM-1, except that 0.08 milligrams per silver mole of $K_2IrCl_5$ (5-Methyl-Thiazole) and 0.24 milligrams per silver mole of $K_2IrCl_5$ (Thiazole) were added during 90 to 95% of grain formation. Each dopant was added to the reaction vessel through a separate jet.

Primitive Emulsions EM-1 through EM-10 were optimally sensitized by conventional methods to form finished emulsion Parts 1.1 through 1.10, respectively. The sequence of chemical sensitizers, spectral sensitizers, and antifoggants addition are the same for each finished emulsion. The sensitization details are as follows: A portion of the primitive silver chloride emulsion was optimally sensitized by the addition of p-glutaramidophenyl disulfide, followed by addition of the optimum amount of sodium thiosulphate, followed by addition of tripotassium bis {2-[3-(2-sulfobenzamido)phenyl]-mercaptotetrazole} gold(I) pentahydrate. The emulsion was then heated to 68° C. and held at this temperature for 28 minutes with subsequent addition of 1-(3-acetamidophenyl)-5-mercaptotetrazole, followed by disodium 2,2'-(1,2-ethenediyl)bis(5-((4-choro-6-((2-chlorophenyl)amino)-1,3,5-triazin-2-yl)amino)-benzenesulfate, followed by potassium tolylthiosulfonate, followed by potassium hexachloroiridate, and followed by addition of potassium bromide. Then the emulsion was cooled to 40° C. and red Spectral Sensitizing Dye A was added.

Spectral Sensitizing Dye A

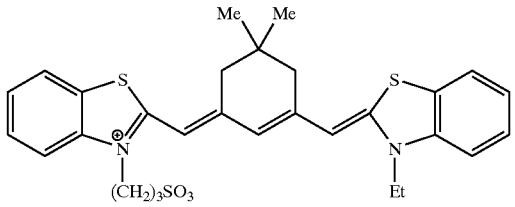

Just prior to coating on resin-coated paper support, the red-sensitized emulsions were dual-mixed with cyan dye forming Coupler A. The coatings contained 194 milligrams silver per square meter, and were overcoated with a gelatin layer and hardened with bis(vinylsulfonylmethyl)ether.

Coupler A:

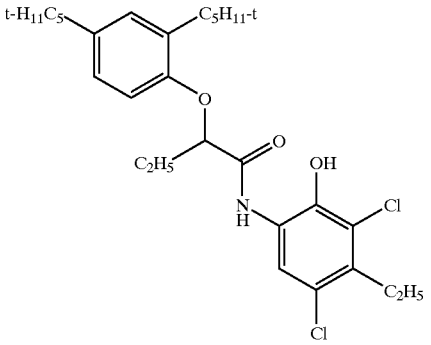

The coatings were exposed through a 21-step wedge (exposure increments of 0.15 log E) with a 3000 K tungsten source at 0.1 second. Densitometry was read in the reflection mode. Speed is reported as the relative log inverse of the light exposure required to produce a reflection optical density of 0.8. A two-fold sensitivity difference equals a speed difference of 30, or 0.30 log E, where E is exposure in lux-seconds. These exposures will be referred to as "Optical Sensitivity" in the following examples.

All coatings were processed in Kodak™ Ektacolor RA-4. Relative optical speeds are reported at optical density level equal to 0.8. LoTOE is defined as the density at an exposure level required to produce an optical reflection density of 0.8 minus 0.4 logE. TOE is defined as the density at an exposure level required to produce an optical reflection density of 0.8 minus 0.2 logE. Lower-scale Contrast is defined as the slope of a line through the TOE density point and the SPEED point (0.8 optical density) on the sensitometric curve, and is given by expression (1) below:

$$(0.8-\text{TOE})/0.2 \quad (1)$$

SHOULDER is reported as the density at an exposure level required to produce an optical reflection density of 0.8 plus 0.4 logE. Upper-scale Contrast is defined as the slope of a line through the SHOULDER density point and the SPEED point (0.8) on the sensitometric curve, and is given by expression (2) below:

$$(\text{SHOULDER}-0.8)/0.4 \quad (2)$$

To obtain optimum tone reproduction, practical photographic print materials are coated at emulsion and coupler levels required to produce a specific SHOULDER density required by a given application. If an emulsion is found to be slightly low in SHOULDER density, it may be recoated at a slightly greater silver laydown so as to maintain the specific SHOULDER density desired for the particular product application. It has been determined by examination of the TOE and SHOULDER densities from a series of coatings with various emulsion laydowns (i.e. contrasts), that a finite change in SHOULDER density is accompanied by an opposite change of typically about one-tenth that amount in the TOE density. Using this relationship, the impact of emulsion laydown adjustments (required to maintain the desired aim SHOULDER density) upon TOE density can be estimated. Normalized TOE is the TOE density estimated to result when a change in emulsion laydown is made to maintain an aim SHOULDER density. Normalized TOE density is given by expression (3) below:

$$\text{TOE}+((\text{SHOULDER}-\text{AIM})/10) \quad (3)$$

where AIM is the desired SHOULDER density to which the emulsion laydown is adjusted. Therefore, the Normalized TOE density is the expected value of TOE if the emulsion is to be used for a specific application with the AIM SHOULDER requirement. Similarly, the Normalized Lower-scale Contrast is the expected value of lower-scale contrast if the emulsion laydown is adjusted to maintain the AIM SHOULDER requirement needed for a specific product application. Normalized Lower-scale Contrast is given by inserting the value of Normalized TOE into expression (1) above.

Optical Sensitometric results for EM-1 through EM-10 are given in Table I below, using an AIM SHOULDER value of 1.9.

TABLE I

| | Optical Sensitivity | | | | | | | | |
|---|---|---|---|---|---|---|---|---|---|
| | | | | | | | NORMALIZED | | |
| Part # | $K_2IrCl_5$ 5-methyl thiazole (mg/Ag mol) | $K_2IrCl_5$ thiazole (mg/Ag mol) | SPEED | LoTOE | TOE | SHOULDER | TOE | Lower-scale Contrast | Delta Lower-scale Contrast |
| Part 1.1 | 0 | 0 | 165 | 0.200 | 0.4175 | 1.900 | 0.4175 | 2.91 | — |
| Part 1.2 | 0 | 0.04 | 164 | 0.197 | 0.414 | 1.938 | 0.4178 | 2.91 | 0.00 |
| Part 1.3 | 0 | 0.08 | 159 | 0.202 | 0.412 | 1.938 | 0.4158 | 2.92 | 0.01 |
| Part 1.4 | 0 | 0.16 | 156 | 0.2045 | 0.416 | 1.933 | 0.4193 | 2.90 | −0.01 |
| Part 1.5 | 0 | 0.24 | 156 | 0.212 | 0.424 | 1.910 | 0.4250 | 2.88 | −0.04 |
| Part 1.6 | 0.08 | 0 | 167 | 0.198 | 0.4155 | 1.913 | 0.4168 | 2.92 | 0.01 |
| Part 1.7 (inv) | 0.08 | 0.04 | 166 | 0.2035 | 0.4245 | 1.928 | 0.4273 | 2.86 | −0.05 |
| Part 1.8 (inv) | 0.08 | 0.08 | 159 | 0.2135 | 0.4295 | 1.918 | 0.4313 | 2.84 | −0.07 |
| Part 1.9 (inv) | 0.08 | 0.16 | 158 | 0.220 | 0.435 | 1.893 | 0.4343 | 2.83 | −0.08 |
| Part 1.10 (inv) | 0.08 | 0.24 | 154 | 0.224 | 0.435 | 1.870 | 0.4320 | 2.84 | −0.07 |

A change in LoTOE or TOE density of 0.005, or a change in Lower-scale Contrast of 0.025, is typically required to impart a noticeable impact on photographic prints. It is evident from Table I above that the $K_2IrC1_5$(Thiazole) dopant used alone has very little effect on contrast, except at the highest level tested. Similarly, when used alone the $K_2IrCl_5$(5-Methyl-Thiazole) dopant has an insignificant impact on the contrast of the emulsion. However, quite unexpectedly, a very significant increase in TOE density and Normalized Toe density, along with an associated decrease in the calculated Lower-scale Contrast and Normalized Lower-scale Contrast, is observed for the combination of $K_2IrCl_5$(Thiazole) and $K_2IrCl_5$(5-Methyl-Thiazole) dopants.

The normalized contrast metrics in Table I above are calculated using the SHOULDER density (1.900) of the comparison Part 1.1 emulsion as the AIM SHOULDER. Therefore the nonnalized contrast metrics directly reflect the practical contrast changes imparted by the combination of iridium dopants. Generally speaking, minor silver laydown adjustment are required to maintain the aim SHOULDER position.

Example 2

This example illustrates the unexpected reduction of the Latent Image Keeping instability by the combination of $K_2IrCl_5$(Thiazole) and $K_2IrCl_5$(5-Methyl-Thiazole) dopants in emulsions sensitized to red light.

Emulsions EM-1, EM4, EM-6 and EM-9 were reprecipitated at a ten-fold larger size, with the $K_2IrCl_5$(5-Methyl-Thiazole) dopant level increased from 0.08 to 0.10 milligrams per silver mole in EM-6 and EM-9, to form primitive Emulsions EM-1*, EM-4*, EM-6*, and EM-9*. The primitive emulsions were chemically and spectrally sensitized as described above for Example 1, to form sensitized emulsion Parts 2.1 through 2.4, respectively. These red-sensitive emulsions were coated along with a green-sensitive and blue-sensitive emulsion and corresponding cyan, magenta and yellow dye forming couplers in a conventional multilayer format. The blue-sensitive emulsion was coated in a layer closest to the reflective support, followed by a color-mixing preventing layer, followed by the green-sensitive emulsion, followed by a color-mixing preventing layer, followed by the red-sensitive emulsion, followed by an overcoat layer.

The multilayer coating was exposed and processed with densitometry read and analyzed as described above. In addition, the Latent Image Keeping (LIK) stability of the red-sensitive emulsion layer was examined by comparing the sensitometric response for a coating processed 2 minutes after exposure to a coating processed 5 minutes after exposure. No change in sensitometry (ΔDensity=0) is the desired result.

TABLE II

Optical Sensitivity and Optical LIK Data

| Part # | $K_2IrCl_5$ 5-methyl thiazole (mg/Ag mol) | $K_2IrCl_5$ thiazole (mg/Ag mol) | SPEED | LoTOE | TOE | SHOULDER | Optical LIK 2 min to 5 min ΔDensity @ SPEED POINT | ΔDensity @ TOE | ΔDensity @ SHOULDER |
|---|---|---|---|---|---|---|---|---|---|
| Part 2.1 | 0 | 0 | 100 | 0.171 | 0.330 | 2.005 | 0.015 | 0.009 | 0.019 |
| Part 2.2 | 0 | 0.16 | 88 | 0.205 | 0.373 | 1.855 | 0.067 | 0.016 | 0.100 |
| Part 2.3 | 0.1 | 0 | 100 | 0.170 | 0.329 | 2.021 | 0.037 | 0.003 | 0.063 |
| Part 2.4 (inv) | 0.1 | 0.16 | 88 | 0.212 | 0.378 | 1.811 | 0.050 | 0.007 | 0.098 |

The results shown above once more illustrate the unexpected advantageous reduction of contrast for the combination of $K_2IrCl_5$(Thiazole) and $K_2IrCl_5$(5-Methyl-Thiazole) dopants. Each of the lower-scale contrast parameters LoTOE and TOE is greater than the predicted result when summing the effect of each dopant used alone. An unexpected reduction in the Latent Image Keeping instability is also shown above for the dopant combination. The undesired increase in density measured at three various points on the sensitometric curve is smaller for the combination of dopants than that predicted based on the sum of the density changes taken from the use of each dopant alone.

Example 3

This example compares the effects of $K_2IrCl_5$(Thiazole), $K_2IrCl_5$(5-Methyl-Thiazole) and the dopant combination on the optical and laser contrast and Latent Image Keeping (LIK) of emulsions sensitized to green light.

Emulsion EM-11: A reaction vessel contained 5.4 L of a solution that was 5.2% in regular gelatin and contained 1.32 g of a Pluronic antifoam agent. To this stirred solution at 46.1° C. was added 84.9 mL of 3.0 M NaCl, and soon after 21.3 mL of dithiaoctanediol solution was poured into the reactor. A half minute after addition of dithiaoctanediol solution, 170.4 mL of a 2.8 M $AgNO_3$ solution and 179.9 mL of 3.0 M NaCl were added simultaneously at 163.8 mL/min for 1.04 minute. The vAg set point was chosen equal to that observed in the reactor at this time. Then the 2.8 M silver nitrate solution and the 3.0 M sodium chloride solution were added simultaneously with a constant flow at 163.8 mL/min over 19.68 minutes. The resulting silver chloride emulsion had a cubic shape that was 0.345 $\mu$m in edge length. The emulsion was then washed using an ultra-filtration unit, and its final pH and pCl were adjusted to 5.6 and 1.8, respectively.

Emulsion EM-12: This emulsion was precipitated exactly as Emulsion EM-11, except that 0.025 milligrams per silver mole of $K_2IrCl_5$(Thiazole) was added during 90 to 95% of grain formation.

Emulsion EM-13: This emulsion was precipitated exactly as Emulsion EM-11, except that 0.050 milligrams per silver mole of $K_2IrCl_5$(Thiazole) was added during 90 to 95% of grain formation.

Emulsion EM-14: This emulsion was precipitated exactly as Emulsion EM-11, except that 0.10 milligrams per silver mole of $K_2Ircl_5$(Thiazole) was added during 90 to 95% of grain formation.

Emulsion EM-15: This emulsion was precipitated exactly as Emulsion EM-11, except that 0.15 milligrams per silver mole of $K_2IrCl_5$(Thiazole) was added during 90 to 95% of grain formation.

Emulsion EM-16: This emulsion was precipitated exactly as Emulsion EM-11, except that 0.40 milligrams per silver mole of $K_2IrCl_5$(5-Methyl-Thiazole) was added during 90 to 95% of grain formation.

Emulsion EM-17: This emulsion was precipitated exactly as Emulsion EM-11, except that 0.025 milligrams per silver mole of $K_2IrCl_5$(Thiazole) and 0.40 milligrams per silver mole of $K_2IrCl_5$(5-Methyl-Thiazole) were added during 90 to 95% of grain formation.

Emulsion EM-18: This emulsion was precipitated exactly as Emulsion EM-11, except that 0.050 milligrams per silver mole of $K_2IrCl_5$(Thiazole) and 0.40 milligrams per silver mole of $K_2IrCl_5$(5-Methyl-Thiazole) were added during 90 to 95% of grain formation.

Emulsion EM-19: This emulsion was precipitated exactly as Emulsion EM-11, except that 0.10 milligrams per silver mole of $K_2IrCl_5$(Thiazole) and 0.40 milligrams per silver mole of $K_2IrCl_5$(5-Methyl-Thiazole) were added during 90 to 95% of grain formation.

Emulsion EM-20: This emulsion was precipitated exactly as Emulsion EM-11, except that 0.025 milligrams per silver mole of $K_2IrCl_5$(Thiazole) and 0.40 milligrams per silver mole of $K_2IrCl_5$(5-Methyl-Thiazole) were added during 90 to 95% of grain formation.

Primitive Emulsions EM-11 through EM-20 were optimally sensitized by conventional methods to form finished emulsion Parts 3.1 through 3.10, respectively. The sequence of chemical sensitizers, spectral sensitizers, and antifoggants addition are the same for each finished emulsion. The sensitization details are as follows: A portion of the primitive silver chloride emulsion was optimally sensitized by the addition of a colloidal suspension of aurous sulfide and heat ramped to 60° C., during which time Lippmann bromide doped with potassium hexachloroiridate, green Spectral Sensitizing Dye B, and 1-(3-acetamidophenyl)-5-mercaptotetrazole were added.

Spectral Sensitizing Dye B

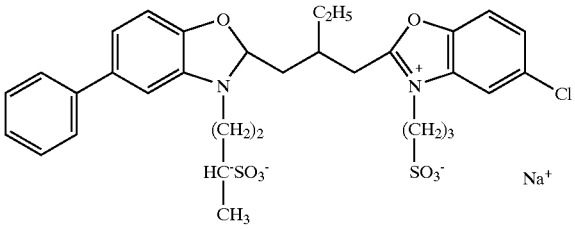

Just prior to coating on resin coated paper support the green-sensitized emulsions were dual-mixed with magenta dye forming Coupler B. The coatings contained 108 milligrams silver per square meter, were overcoated with a gelatin layer and hardened with bis(vinylsulfonylmethyl) ether.

Coupler B:

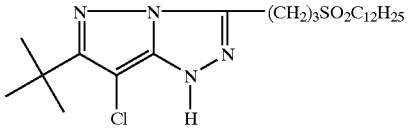

The coatings were optically exposed and processed with densitometry read as described above. The densitometry was analyzed as follows. Relative optical speeds are reported at a density level equal to 1.0. In this example, LoTOE is defined as the density at an exposure level required to produce an optical reflection density of 1.0 minus 0.5 logE. TOE is defined as the density at an exposure level required to produce an optical reflection density of 1.0 minus 0.3 logE, while SHOULDER is reported as the density at an exposure level required to produce an optical reflection density of 1.0 plus 0.3 logE. Normalized contrast parameters are estimated assuming silver laydown adjustments are made to maintain an AIM SHOULDER density of 2.1.

For this example, Lower-scale Contrast is defined as the slope of a line through the TOE density point and the SPEED point (1.0 optical density) on the sensitometric curve, and is given by expression (4) below:

$$(1.0-\text{TOE})/0.3 \tag{4}$$

Results from these exposures will be referred to as "Optical Sensitivity" in this example, summarized in Table III.

The coatings were also exposed with a Toshiba TOLD 9140™ exposure apparatus at 532 nm (green sensitized emulsions), a resolution of 176.8 pixels/cm, a pixel pitch of 42.47 $\mu$m, and an exposure time of 1 microsecond per pixel. Relative laser speeds are reported at a density level equal to 1.0. Results from these exposures will be referred to as "Digital Sensitivity" in this example. In addition the Latent Image Keeping (LIK) stability of the green-light sensitive emulsion layer was examined by comparing the digital sensitometric response for coatings processed 20 seconds, 2 hours and 24 hours after exposure. No change in sensitometry ($\Delta$Density=0) is the desired result. Sensitometric laser exposure data and LIK responses are summarized in Table IV.

TABLE III

| | | | Optical Sensitometry | | | | | | |
|---|---|---|---|---|---|---|---|---|---|
| | | | | | | | | NORMALIZED | |
| Part # | $K_2IrCl_5$ 5-methyl thiazole (mg/Ag mol) | $K_2IrCl_5$ thiazole (mg/Ag mol) | SPEED | LoTOE | TOE | SHOULDER | TOE | Lower-scale Contrast | Delta Lower-scale Contrast |
| Part 3.1 | 0 | 0 | 197 | 0.176 | 0.345 | 2.081 | 0.3431 | 2.19 | — |
| Part 3.2 | 0 | 0.025 | 192 | 0.181 | 0.358 | 2.062 | 0.3542 | 2.15 | −0.04 |
| Part 3.3 | 0 | 0.05 | 188 | 0.192 | 0.369 | 2.021 | 0.3611 | 2.13 | −0.06 |
| Part 3.4 | 0 | 0.10 | 183 | 0.204 | 0.389 | 2.006 | 0.3796 | 2.07 | −0.12 |
| Part 3.5 | 0 | 0.15 | 175 | 0.213 | 0.414 | 1.901 | 0.3941 | 2.02 | −0.17 |
| Part 3.6 | 0.4 | 0 | 186 | 0.186 | 0.349 | 2.056 | 0.3446 | 2.18 | −0.01 |
| Part 3.7 (inv) | 0.4 | 0.025 | 180 | 0.191 | 0.373 | 2.041 | 0.3671 | 2.11 | −0.08 |
| Part 3.8 (inv) | 0.4 | 0.05 | 179 | 0.202 | 0.391 | 2.016 | 0.3826 | 2.06 | −0.13 |
| Part 3.9 (inv) | 0.4 | 0.10 | 175 | 0.207 | 0.403 | 2.003 | 0.3933 | 2.02 | −0.17 |
| Part 3.10 (inv) | 0.4 | 0.15 | 169 | 0.238 | 0.442 | 1.854 | 0.4174 | 1.94 | −0.25 |

TABLE IV

Laser Sensitivity and Laser LIK Data.

| Part # | $K_2IrCl_5$ 5-methyl thiazole (mg/Ag mol) | $K_2IrCl_5$ thiazole (mg/Ag mol) | SPEED | LoTOE | TOE | SHOULDER | Laser LIK 20 sec to 2 hr ΔDensity @ SPEED | Laser LIK 20 sec to 2 hr ΔDensity @ SPEED + 0.2 log E | Laser LIK 20 sec to 24 hr ΔDensity @ SPEED | Laser LIK 20 sec to 24 hr ΔDensity @ SPEED + 0.2 logE |
|---|---|---|---|---|---|---|---|---|---|---|
| Part 3.1 | 0 | 0 | 127 | 0.278 | 0.483 | 1.678 | 0.0362 | 0.0578 | 0.0458 | 0.0868 |
| Part 3.2 | 0 | 0.025 | 136 | 0.229 | 0.411 | 1.747 | 0.0386 | 0.0482 | 0.0386 | 0.0603 |
| Part 3.3 | 0 | 0.05 | 134 | 0.225 | 0.401 | 1.886 | 0.0531 | 0.0675 | 0.0578 | 0.0772 |
| Part 3.4 | 0 | 0.10 | 130 | 0.220 | 0.397 | 1.922 | 0.0578 | 0.0771 | 0.0651 | 0.0867 |
| Part 3.5 | 0 | 0.15 | 121 | 0.235 | 0.426 | 1.803 | 0.0675 | 0.0867 | 0.0843 | 0.1061 |
| Part 3.6 | 0.4 | 0 | 137 | 0.212 | 0.383 | 2.042 | 0.0578 | 0.0819 | 0.0772 | 0.1108 |
| Part 3.7 (inv) | 0.4 | 0.025 | 130 | 0.214 | 0.391 | 1.984 | 0.0434 | 0.0636 | 0.0492 | 0.0819 |
| Part 3.8 (inv) | 0.4 | 0.05 | 128 | 0.222 | 0.395 | 1.958 | 0.0385 | 0.0530 | 0.0626 | 0.0771 |
| Part 3.9 (inv) | 0.4 | 0.10 | 125 | 0.227 | 0.407 | 1.935 | 0.0386 | 0.0434 | 0.0530 | 0.0675 |
| Part 3.10 (inv) | 0.4 | 0.15 | 118 | 0.249 | 0.442 | 1.816 | 0.0382 | 0.0428 | 0.0512 | 0.0669 |

The Optical Sensitivity results shown above once again illustrate the unexpected advantageous reduction of contrast for the combination of $K_2IrCl_5$(Thiazole) and $K_2IrCl_5$(5-Methyl-Thiazole) dopants. Each of the lower-scale contrast parameters LoTOE, TOE, and normalized TOE is greater than the predicted result when summing the effect of each dopant used alone. This is most readily seen in the TOE region of the sensitometric curve. Consider, for instance, the Normalized Lower-scale Contrast, for which a difference 0.025 is required to impart a substantial impact on photographic prints. Comparison of Part 3.6 to Part 3.1 indicates that the $K_2IrCl_5$(5-Methyl-Thiazole) dopant affords only a 0.01 reduction in Normalized Lower-scale Contrast, an insignificant effect. Comparison of Parts 3.2, 3.3, 3.4, 3.5 to 3.1 indicates that a level series in the $K_2IrCl_5$(Thiazole) dopant reduces the Normalized Lower-scale Contrast significantly (0.04, 0.06, 0.12, 0.17; respectively). Comparison of Parts 3.7, 3.8, 3.9, 3.10 to 3.1 indicates that the combination of dopants greatly reduces the Normalized Lower-scale Contrast (0.08, 0.13, 0.17, 0.25; respectively). This is quite unexpected in light of the fact that when used alone the $K_2IrCl_5$(5 -Methyl-5 Thiazole) dopant has an insignificant effect.

The Laser Sensitivity and Laser LIK Data results shown above once more illustrate the unexpected advantageous reduction of contrast for the combination of $K_2IrCl_5$ (Thiazole) and $K_2IrCl_5$(5-Methyl-Thiazole) dopants. Each of the lower-scale contrast parameters LoTOE and TOE is greater than the predicted result when summing the effect of each dopant used alone. An unexpected reduction in the Latent Image Keeping instability is also shown above for the dopant combination. The undesired increase in density measured at various points on the sensitometric curve is generally smaller for the combination of dopants than that predicted based on the sum of the density changes taken from the use of each dopant alone.

Example 4

This example compares the effects of $K_2IrCl_5$(Thiazole), $K_2IrCl_5$(5-Methyl-Thiazole) and the dopant combination on the optical sensitometry of a pulsed flow precipitated emulsion which is spectrally sensitized to blue light.

Emulsion EM-21: To a reactor incorporating a stirring device as disclosed in *Research Disclosure*, Item 38213, and containing 8.921 grams of distilled water, 25 milligrams of p-glutaramidophenyldisulfide and 250 grams of bone gelatin, were added 294 grams of 3.8 M sodium chloride salt solution such that the mixture was maintained at a pCl of about 1.05 at approximately 68° C. To this were added 1.9 grams of 1,8-dihydroxy-3,6-dithiaoctane approximately 30 seconds before commencing introduction of silver and chloride salt solutions. Aqueous solutions of about 3.7 M silver nitrate and about 3.8 M sodium chloride were then added by conventional controlled double-jet addition at a constant silver nitrate flow rate of about 104.4 milliliters/minute for about 1.28 minutes while maintaining pCl constant at about 1.05. A 1.0 minute rest period followed nucleation. The remainder of the silver nitrate and sodium chloride for growth of 91% of the core of the grain was delivered with five double-jet pulses at the flow rate of about 234 milliliters/minute separated by hold periods. The duration of the pulses were 0.75, 0.75, 3.0, 5.03, and 3.0 minutes, respectively. There was a period of rest after each successive pulse. The duration of rests were 5, 3, 3, 3, and 2 minutes, respectively. Both the silver nitrate and sodium chloride solution pumps were then turned off and about 0.8 M potassium iodide solution was added to the stirred reaction mixture over about 0.5 min at a constant flow rate of about 62.5 milliliters/min. Following a 0.5 min rest period, the resultant iodochloride emulsion was then grown further by pulsed controlled double-jet addition for about 1.3 minutes by resumed addition of silver and sodium salt solutions at about 226 mL/min at a pCl of about 1.05. The solution was then held for one minute. In addition, 0.56 micrograms of $Cs_2Os(NO)Cl_5$ was added at approximately 35 to 71% into the precipitation. A total of 12.5 moles of a silver iodochloride emulsion was thus prepared with 0.2 mole % iodide added at 91% of total grain volume. Cubic edge length was 0.61 $\mu$m.

Emulsion EM-22: This emulsion was prepared exactly as Emulsion EM-21 except that a 2 N NaCl solution containing 0.25 milligrams of $K_2IrCl_5$(Thiazole) was added during 85 to 88% of the precipitation.

Emulsion EM-23: This emulsion was prepared exactly as Emulsion EM-21 except that a 2 N NaCl solution containing 0.50 milligrams of $K_2IrCl_5$(Thiazole) was added during 85 to 88% of the precipitation.

Emulsion EM-24: This emulsion was prepared exactly as Emulsion EM-21 except that a 2 N NaCl solution containing 0.90 milligrams of $K_2IrCl_5$(5-Methyl-Thiazole) was added during 85 to 88% of the precipitation.

Emulsion EM-25: This emulsion was prepared exactly as Emulsion EM-21 except that a 2 N NaCl solution containing 0.25 milligrams of $K_2IrCl_5$(Thiazole) and 1.80 milligrams of $K_2IrCl_5$(5-Methyl-Thiazole) was added during 85 to 88% of the precipitation.

Emulsion EM-26: This emulsion was prepared exactly as Emulsion EM-21 except that a 2 N NaCl solution containing 0.25 milligrams of $K_2IrCl_5$(Thiazole) and 1.80 milligrams of $K_2IrCl_5$(5-Methyl-Thiazole) was added during 85 to 88% of the precipitation.

Primitive Emulsions EM-21 through EM-26 were optimally sensitized by conventional methods to form finished emulsion Parts 4.1 through 4.6, respectively. The sequence of chemical sensitizers, spectral sensitizers, and antifoggants addition are the same for each finished emulsion. The sensitization details are as follows: A portion of the primitive silver iodochloride emulsion was optimally sensitized by the addition of p-glutaramidophenyldisulfide, followed by a colloidal suspension of aurous sulfide and heat ramped to 60° C., during which time Lippmann bromide doped with potassium hexachloroiridate, yellow Spectral Sensitizing Dye C and 1-(3-acetamidophenyl)-5-mercaptotetrazole were added.

Spectral Sensitizing Dye C

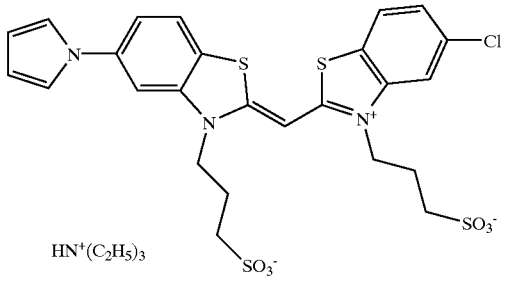

Just prior to coating on resin-coated paper support the blue-sensitized emulsions were dual-mixed with yellow dye forming Coupler C. The coatings contained 108 milligrams silver per square meter, were overcoated with a gelatin layer and hardened with bis(vinylsulfonylmethyl)ether.

Coupler C:

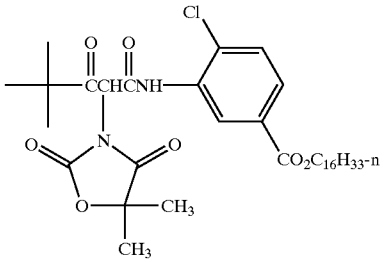

The coatings were exposed, processed, and densitometry read and analyzed as described in Example 1 above. Optical sensitometric data are summarized in Table V below.

TABLE V

Optical Sensitivity

| Part # | $K_2IrCl_5$ 5-methyl thiazole mg/Ag mol | $K_2IrCl_5$ thiazole mg/Ag mol | SPEED | LoTOE | TOE | SHOULDER |
|---|---|---|---|---|---|---|
| Part 4.1 | 0 | 0 | 160 | 0.225 | 0.449 | 1.80 |
| Part 4.2 | 0 | 0.02 | 163 | 0.200 | 0.413 | 1.86 |
| Part 4.3 | 0 | 0.04 | 161 | 0.205 | 0.422 | 1.90 |
| Part 4.4 | 0.0722 | 0 | 166 | 0.177 | 0.386 | 1.97 |
| Part 4.5 (inv) | 0.0722 | 0.02 | 165 | 0.195 | 0.410 | 1.91 |
| Part 4.6 (inv) | 0.0722 | 0.04 | 162 | 0.198 | 0.412 | 1.88 |

The results shown above once more illustrate the unexpected advantageous impact upon of contrast for the combination of $K_2IrCl_5$(Thiazole) and $K_2IrCl_5$(5-Methyl-Thiazole) dopants. For the codoped emulsions of the invention (Part 4.5 and Part 4.6), each of the lower-scale contrast parameters LoTOE and TOE is greater than the predicted result when summing the effect of each dopant used alone. Either dopant used alone increases the lower-scale contrast (i.e. smaller LoTOE and LOE values) relative to the comparison Part 4.1. The expected effect on LoTOE and TOE for the combination of the two dopants is the sum of these two lower-scale contrast increasing effects. Thus the expected result for the combination of dopants is a LoTOE value less than 0.177 and a TOE value less than 0.386. A lower-scale contrast of this magnitude would be too great for many practical imaging purposes.

It is specifically contemplated that emulsions in accordance with the invention may be sensitized with red, green, and blue sensitizing dyes and be incorporated in a color paper format as described in Example 4 of U.S. Pat. No. 5,783,373, incorporated by reference above.

The invention has been described in detail with particular reference to preferred embodiments thereof, but it will be understood that variations and modifications can be effected within the spirit and scope of the invention.

What is claimed is:

1. A radiation-sensitive emulsion comprised of silver halide grains (a) containing greater than 50 mole percent chloride, based on silver, (b) having greater than 50 percent of their surface area provided by {100} crystal faces, and (c) having a central portion accounting for up to 99 percent of total silver and containing (i) a first dopant comprising an iridium coordination complex containing at least one thiazole ligand and (ii) a second dopant comprising an iridium coordination complex containing at least one substituted thiazole ligand, wherein each of the first and second dopants are iridium coordination complexes having ligands each of which are more electropositive than a cyano ligand, wherein the remaining non-thiazole or non-substituted-thiazole ligands of the first and second iridium dopant coordination complexes are halide ligands.

2. A radiation-sensitive emulsion comprised of silver halide grains (a) containing greater than 50 mole percent chloride, based on silver, (b)having greater than 50 percent of their surface area provided by {100} crystal faces, and (c) having a central portion accounting for up to 99 percent of total silver and containing (i) a first dopant comprising an iridium coordination complex containing at least one thiazole ligand and (ii) a second dopant comprising an iridium coordination complex containing at least one substituted thiazole ligand, wherein the first and second iridium dopants comprise hexacoordination complexes satisfying the formula:

$$[IrL^1_6]^{n'} \quad (I)$$

wherein n' is zero, −1, −2, −3 or −4; and $L^1_6$ represents six bridging ligands which can be independently selected, provided that at least four of the ligands are anionic ligands, each of the ligands is more electropositive than a cyano ligand, and at least one of the ligands comprises a thiazole ligand for the first dopant and at least one of the ligands comprises a substituted thiazole ligand for the second dopant.

3. An emulsion according to claim 2, wherein the substituted thiazole ligand of the second dopant comprises a thiazole group substituted with an alkyl group containing 1–4 carbon atoms.

4. An emulsion according to claim 2, wherein the substituted thiazole ligand of the second dopant comprises a 5-methylthiazole group.

5. An emulsion according to claim 2, wherein at least four of the ligands for each of the first and second dopants are halide ligands.

6. An emulsion according to claim 5 wherein the first dopant is an iridium coordination complex containing five halide ligands and a thiazole ligand and the second dopant is an iridium coordination complex containing five halide ligands and a 5-methyl thiazole ligand.

7. An emulsion according to claim 2, wherein the first dopant comprises $[IrCl_5(thiazole)]^{-2}$ and the second dopant comprises $[IrCl_5(5\text{-methylthiazole})]^{-2}$.

8. An emulsion according to claim 7, wherein the first and second dopants are located in a common dopant band within the central portion of the silver halide grains.

9. An emulsion according to claim 2, wherein the first and second dopants are located within the central portion of the grains within an interior region surrounding at least 50 percent of the total silver forming the grains.

10. An emulsion according to claim 9, wherein the first dopant is present in a concentration of from $10^{-9}$ to $10^{-4}$ mole per mole of silver, and the second dopant is present in a concentration of from $10^{-9}$ to −4 mole per mole of silver.

11. An emulsion according to claim 10 wherein the first dopant is present in a concentration of from $10^{-8}$ to $10^{-5}$ mole per silver mole.

12. An emulsion according to claim 10 wherein the second dopant is present in a concentration from $10^{-8}$ to $10^{-5}$ mole per silver mole.

13. An emulsion according to claim 2, wherein the silver halide grains contain at least 70 mole percent chloride, based on silver.

14. An emulsion according to claim 2, wherein the silver halide grains contain less than 5 mole percent iodide, based on silver.

15. A photographic recording element comprising a support bearing at least one radiation-sensitive silver halide emulsion layer comprising an emulsion according to claim 2.

16. An electronic printing method which comprises subjecting the radiation sensitive silver halide emulsion layer of a recording element according to claim 15 to actinic radiation of at least $10^{-4}$ ergs/cm$^2$ for up to 100 $\mu$ seconds duration in a pixel-by-pixel mode.

17. A method according to claim 16 wherein the pixels are exposed to actinic radiation of about $10^{-3}$ ergs/cm$^2$ to $10^{-2}$ ergs/cm$^2$.

18. A method according to claim 16 wherein the exposure is up to 10$\mu$ seconds.

19. A method according to claim 16 wherein the source of actinic radiation is a light emitting diode.

20. A method according to claim 16 wherein the source of actinic radiation is a laser.

* * * * *

UNITED STATES PATENT AND TRADEMARK OFFICE

CERTIFICATE OF CORRECTION

PATENT NO. : 6,562,559 B2
DATED : May 13, 2003
INVENTOR(S) : Jerzy Z. Mydlarz et al.

It is certified that error appears in the above-identified patent and that said Letters Patent is hereby corrected as shown below:

Column 26,
Line 4, change "__-4" to -- $10^{-4}$ --

Signed and Sealed this

Fifth Day of October, 2004

JON W. DUDAS
*Director of the United States Patent and Trademark Office*